United States Patent [19]

Maekawa

[11] Patent Number: 4,731,977

[45] Date of Patent: Mar. 22, 1988

[54] ROBOT SYSTEM FOR ENCASING CONICAL ARTICLES

[75] Inventor: Hiroshi Maekawa, Joyo, Japan

[73] Assignee: Murata Kikai Kabushiki Kaisha, Kyoto, Japan

[21] Appl. No.: 88,038

[22] Filed: Aug. 19, 1987

Related U.S. Application Data

[63] Continuation of Ser. No. 795,217, Nov. 5, 1985, abandoned.

[30] Foreign Application Priority Data

Nov. 5, 1984 [JP] Japan ..... 59-233487

[51] Int. Cl.[4] ..... B65B 35/30

[52] U.S. Cl. ..... 53/443; 53/475; 53/537; 53/540; 53/247; 53/143

[58] Field of Search ..... 53/143, 149–157, 53/247, 249, 251, 446, 447, 474, 475, 531, 537, 538, 544, 142, 144, 540, 443; 414/30, 56, 31, 59, 55

[56] References Cited

U.S. PATENT DOCUMENTS

| | | | |
|---|---|---|---|
| 3,068,624 | 12/1962 | Linda | 53/531 X |
| 3,612,299 | 10/1971 | Shaw et al. | 53/537 X |
| 3,908,812 | 9/1975 | Graff | 53/531 X |
| 4,035,986 | 7/1977 | Clem et al. | 53/247 X |
| 4,048,783 | 9/1977 | Raudat et al. | 53/544 X |
| 4,051,652 | 10/1977 | Hirano et al. | 53/247 X |
| 4,199,918 | 4/1980 | Peterson | 53/537 |
| 4,203,274 | 5/1980 | Warkentin et al. | 53/251 X |
| 4,364,702 | 12/1982 | Coussot | 414/55 X |
| 4,435,941 | 3/1984 | Booth et al. | 53/247 X |

FOREIGN PATENT DOCUMENTS

| | | | |
|---|---|---|---|
| 2203011 | 8/1972 | Fed. Rep. of Germany | 53/142 |
| 2528008 | 12/1983 | France | 53/143 |

*Primary Examiner*—Robert L. Spruill
*Assistant Examiner*—Steven P. Weinrouch
*Attorney, Agent, or Firm*—Spensley Horn Jubas & Lubitz

[57] ABSTRACT

A robot system for encasing conical articles, having along a moving path of a robot a conical article arraying and feeding device, an empty case for enclosing therein said conical articles and an inverting device for carrying and inverting a plurality of said conical articles, the robot having two kinds of grippers, one functioning to grip and convey the conical articles arranged on the arraying and feeding device and the other functioning to grip and convey the conical articles inverted on the inverting device.

18 Claims, 12 Drawing Figures

ROBOT SYSTEM FOR ENCASING CONICAL ARTICLES

This is a continuation of application Ser. No. 795,217 filed on Nov. 5, 1985 now abandoned.

FIELD OF THE INVENTION AND RELATED ART STATEMENT

The present invention relates to a conical article encasing system using a robot.

As to encasing conical articles such as yarn windings, considerations have been made so that erected and inverted conical articles are alternately inserted in a case to enhance the article packing rate in the case and at the same time prevent shaking of the articles therein.

The above method is the best way of encasing conical articles, but if the position of an erected conical article initially inserted in a case is not correct, the insertion of an inverted conical article subsequently inserted may become incomplete, or even when the position of the initially inserted conical article is correct, if the insertion of the subsequently inserted inverted conical article may become incomplete if its inserted position or its inverted posture for insertion is incorrect. Consequently, it becomes impossible to effect the encasing operation to a perfect extent, and particularly where a large number of conical articles are to be encased in many stages, the above incompletely inserted state is apt to be accumulated. For this reason, with conventional industrial robots and according to the foregoing conventional method, it has been difficult to encase a large number of conical articles.

OBJECT AND SUMMARY OF THE INVENTION

It is an object of the present invention to provide a novel robot system which permits a complete and satisfactory encasing operation even when the foregoing encasing method is applied to encasing a large number of conical articles in many stages.

The robot system of the present invention has, along a moving path of a robot, a conical article arraying and feeding device, an empty case for enclosing therein the conical articles and an inverting device for carrying and inverting a plurality of the conical articles, the robot having two kinds of grippers, one functioning to grip and convey the conical articles arranged on the arraying and feeding device and the other functioning to grip and convey the conical articles inverted on the inverting device.

DESCRIPTION OF PREFERRED EMBODIMENTS

Figures 1, 2:
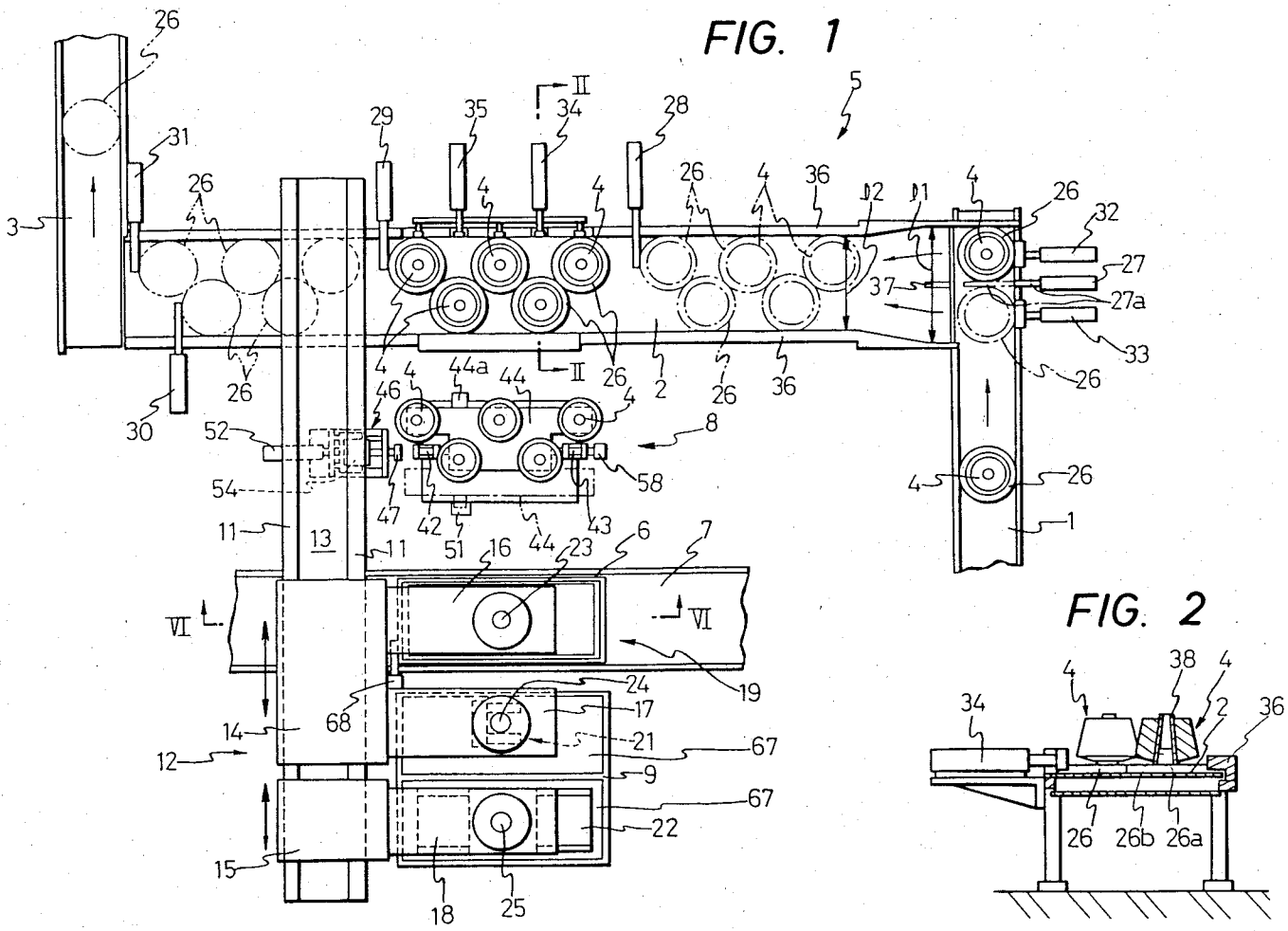
FIG. 1 is a plane arrangement view of an encasing robot system according to an embodiment of the invention.
FIG. 2 is a sectional view taken on line II—II of FIG. 1.

FIG. 1 is a plane arragement view of a cone encasing robot system according to an embodiment of the present invention. On the floor are disposed three continuous belt conveyors 1, 2 and 3. Also arranged on an approximately straight line are an arraying and feeding device 5 for yarn winding cones 4 which device 5 comprises partitioning cylinders and pusher cylinders attached at various points to the belt conveyors 1, 2 and 3; a feed belt conveyor 7 for a cone housing empty case 6 travelling in parallel with the belt conveyor 2; an inverting device for the cone 4 positioned between the belt conveyors 7 and 2; and a partitioning board carrying table 9. An orthogonal coordinates type robot 12 having a rail 11 is disposed between the belt conveyor 2 and the carrying table 9. The numeral 13 denotes a gate-like support for the rail 11 and the numerals 14 and 15 denote moving frames adapted to move along the rail 11. Projecting from the moving frames 14 and 15 are arms 16, 17 and 18 which intersect the rail 11 perpendicularly. Supported vertically movably by the arms 16, 17 and 18 are a gripper 19 for gripping cones on the arraying and feeding device 5, a gripper 21 for gripping an inverting table on the inverting device 8, and a board attracting head 22. Numerals 23, 24 and 25 denote lift arms for the grippers 19, 21 and the attracting head 22.

In this embodiment, as described above, the arraying and feeding device 5, the empty case feeding belt conveyor 7, the inverting device 8 and the board carrying table 9 are arranged in parallel on an approximately straight line, so the grippers 19, 21 and the attracting head 22 need not move in directions along the arms 16, 17 and 18; they are movable only vertically through the lift arms 23, 24 and 25 at end portions of the arms 16, 17 and 18. But where the arrangement of the components 5, 7, 8 and 9 is different, the grippers 19, 21 and the attracting head 22 may be constructed movably in the longitudinal direction of the arms 16, 17 and 18.

Moreover, although in the above example the arms 16 and 17 which support the grippers 19 and 21 are fixed to a common moving frame 14, they may be fixed to separate moving frames so that the grippers 19 and 21 can move on the rail 11 each independently.

The devices 5 and 8 will be explained below in this order.

First, as previously noted, the arraying and feeding device 5 for the cone 4 is composed of three belt conveyors—an incoming belt conveyor 1, an arraying belt conveyor 2 and an outgoing belt conveyor 3 for bobbin trays 26 as well as partitioning cylinders 27, 28, 29, 30 and 31, and pusher cylinders 32, 33, 34 and 35. On the arraying belt conveyor 2 are provided on both sides guide plates 36 which are spaced from each other so as to have a width $l_1$ corresponding to two bobbin trays 26 on an inlet side and a width $l_2$ somewhat narrower than the width of two bobbin trays 26 at an intermediate portion. When the bobbin trays 26 (hereinafter referred to as "full trays") having erected thereon the cones 4 conveyed on the incoming belt conveyor 1 are pushed out alternately sideways by the pusher cylinders 32 and 33, the head tray 26 is stopped by projection of the partitioning cylinder 28, so that the full trays 26 are arranged in a zigzag form as indicated by alternate long and short dash line in FIG. 1 in the intermediate portion defined by the guide plates 36 of the narrow width $l_2$. The full trays 26 which have been conveyed to the end portion of the incoming belt conveyor 1 are pushed out alternately by the pusher cylinders 32 and 33. This alternate switching is effected by appearance and disappearance of a rod 27*a* of the partitioning cylinder 27. The numeral 37 denotes a partition plate provided at the inlet of the arraying belt conveyor 2.

Five full trays 26 which have been arrayed on an inlet portion of the conveyor 2 by projection of the partitioning cylinder 28 move forward in this array on the belt conveyor 2 upon withdrawal of the cylinder 28 until they are again stopped in an intermediate position of the conveyor 2 by the partitioning cylinder 29 which is in a projecting state. Thereafter, the lower two solid trays 26 in FIG. 1 are pushed by projection of the pusher cylinders 34 and 35, whereby the zigzag arrangement of the five full trays 26 is put into order.

In the zigzag arrangement (solid line in FIG. 1) of the full trays thus stopped by the partitioning cylinder 29, the cone 4 is drawn out and lifted from each bobbin tray 26 by means of the gripper 19. Each bobbin tray 26 (hereinafter referred to a "empty tray") which has thus become empty after removal of the cone 4 moves up to the other end of the conveyor 2 upon withdrawal of the partitioning cylinder 29, and by repetition of alternate projection and withdrawal of the partitioning cylinders at the end of the conveyor 2, the empty trays are transferred one by one onto the outgoing belt conveyor 3.

The bobbin tray 26, as shown in FIG. 2, comprises a disc 26*a* having a predetermined diameter and a protrusion 26*b* formed centrally on the disc 26*a* for insertion into a core pipe 38 of the cone 4. The diameter of the disc 26*a* and the width $l_2$ of the intermediate portion defined by the guide plates are set so that the positions of the cones 4 arranged in a zigzag form on the conveyor 2 as mentioned above are coincident with the positions of erected cones 4 enclosed in the empty case 6 as will be described later.

Figure 3:
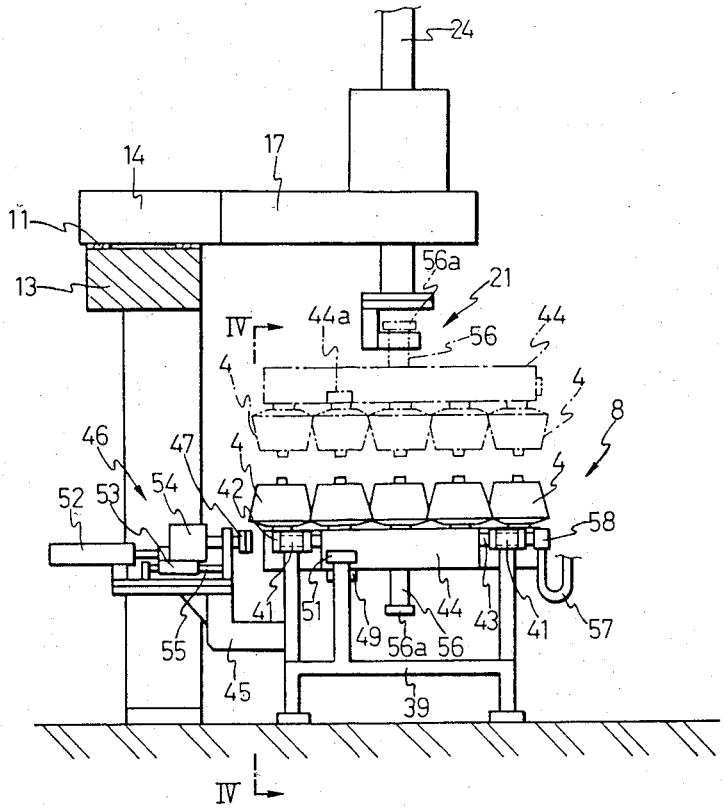
FIG. 3 is a side view of an inverting device and an inverting table holding gripper.
Figure 4:
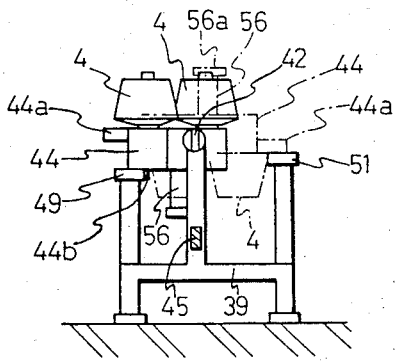
FIG. 4 is a front view of the inverting device being taken on line IV—IV of FIG. 3.

The cone inverting device 8 will now be explained. As shown in FIGS. 3 and 4, the inverting device 8 in this embodiment is composed of an inverting table 44 mounted rotatably through support shafts 42 and 43 at both ends thereof which shafts are supported by U-shaped bearing members 41 each located on the support base 39 and having an open upper portion, and a rotation drive unit 46 for the inverting table 44 which drive unit is fixed onto the support base 39 through a bracket 45. As a driving head 47 of the rotation drive unit 46 rotates into engagement with an end portion of one support shaft 42, the whole of the inverting table 44 inverts itself by 180 degrees on the support base 39. Numeral 44*a* denotes a stopper plate projecting from a side face of the inverting table 44. In a normal condition indicated by solid lines in FIG. 4 in which a later-described cone engaging device 48 forms an upper surface, a bottom 44*b* of the inverting table is in abutment with a stopper 49 on the support base 39, while in an inverted condition indicated by chain lines in FIG. 4, the stopper plate 44*a* is in abutment with the other-side stopper 51 on the support base 39 to effect positioning.

Since a centroidal position of the inverting table 44 is set closer to the stopper plate 44*a* relative to the support shafts 42 and 43, the positioned state by the abutment of the bottom 44*b* with the stopper 49 and that by the abutment of the stopper plate 44*a* with the stopper 51 are kept stable.

The rotation drive unit 46 includes a rotary actuator 54 having the driving head 42 and mounted on a movable base 53 which is movable forward and backward on the bracket 45. A fore end of the driving head 47 and the end portion of the support shaft 42 constitute a claw clutch. Numeral 55 denotes a guide rod for the movable base 53.

The inverting table 44 will now be explained. This inverting table is generally convex in plan view, and a protrusion 56 capable of being gripped by the gripper 21 of the robot is formed approximately centrally on the lower surface of the inverting table in a normal condition (solid lines in FIGS. 3 and 4), while on the upper surface thereof are provided a cone engaging device 48 of the following structure.

Figure 5:
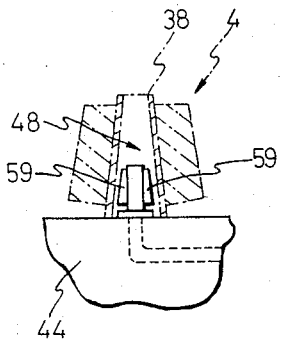
FIG. 5 is a schematic side view of a cone engaging device.

To the support shaft 43 is connected a driving pressurized air through a hose 57 and a swivel joint 58 from an air source (not shown) mounted on the floor or on the arm 17, and engaging pieces 59 (shown in FIG. 5) adapted to be opened and closed radially by turning on and off of the pressurized air are provided at five places on the upper surface of the inverting table 44. Each engaging piece 59 in an open state comes into close contact and engagement with the inner surface of the core pipe 38 of the cone 4 and in a closed state becomes disengaged from the said inner surface. The engaging pieces 59 provided at the five places are arranged in a zigzag form on the inverting table 44. This arrangement, like the foregoing arragement on the arraying and feeding device 5, is set so as to become coincident with the positions of the erected cones 4 encased in the empty case 6.

Figure 6:
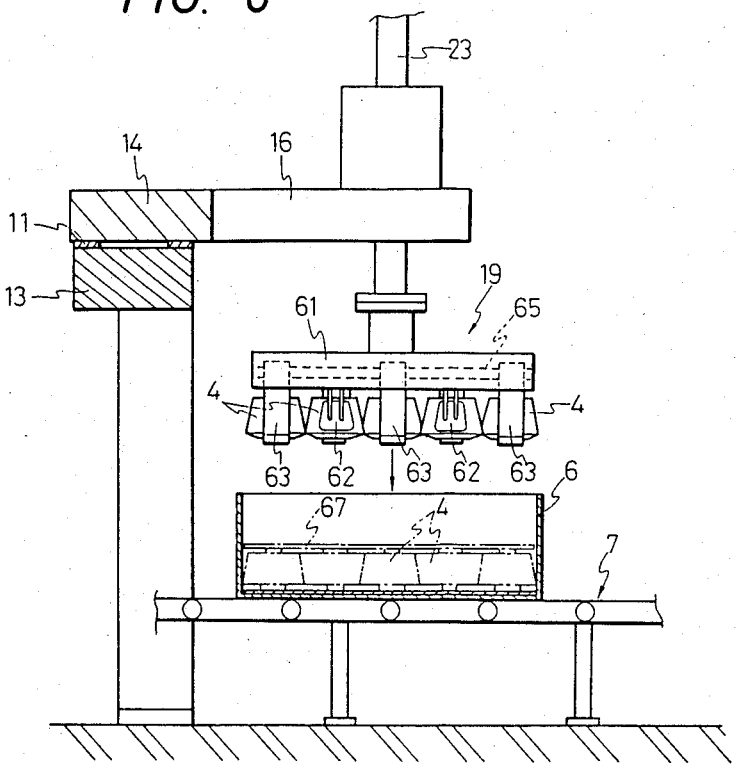
FIG. 6 is a side view of an erected cone holding gripper.
Figure 7:
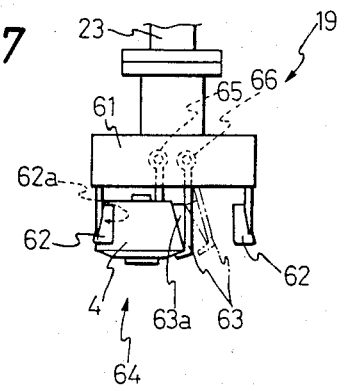
FIG. 7 is a front view thereof.

The grippers 19 and 21 on the arms 16 and 17 will now be explained. The cone holding gripper 19, as shown in FIGS. 6 and 7, is composed of a gripper housing 61 and gripper units 64 each comprising a fixed piece 62 and an opening/closing pawl 63 which are arranged in a zigzag form at five places of the lower surface of the housing 61. The positions of the gripper units 64 are set coincident with the positions of the erected cones 4 arranged in a zigzag form on the arraying and feeding device 5. As the gripper 19 descends onto the erected cones 4 arranged on the arraying and feeding device 5, each gripper unit 64 grips one cone 4.

More specifically, the fixed piece 62 is a curved plate having a conical contact surface 62*a* suspended fixedly from the housing 61. The opening/closing pawls 63 are each a hook plate fixed at a base end portion thereof to a pivotable line shaft 65 or 66 and thereby rendered pivotable relative to the housing 61. If the gripper 19 is brought down in an open state of the opening/closing pawl 63 as indicated by a chain line in FIG. 7, first the inner surface of the fixed piece 62 comes into contact with the outside face of the cone 4, so if the pawl 63 is then closed, the cone 4 comes to be supported at its outside face by the fixed piece 62 and at its bottom by the pawl 63 as indicated by solid lines in FIG. 7.

An outer peripheral shape in plan view of the gripper housing 61 is formed somewhat smaller than the opening size of the empty case 6 so that the whole of the gripper 19 can enter the empty case 6. Also, the fixed pieces 62 are set to size and mounting position not protruding from the gripper housing 61 in plan view.

To the line shaft 66 are connected and fixed two opening/closing pawls 63 on one side and to the line shaft 65 are connected and fixed three opening/closing pawls 63 on the other side. The line shafts 65 and 66 are each connected to a rotation drive source such as a cylinder or the like so that the pawls 63 of each row can be pivotally opened or closed at a time. Numeral **63*a* denotes a abutting member against the cone which abutting member 63*a* is fixed to the inside surface of each pawl 63**.

The gripper 21 for gripping the inverting table is of a type capable of sideways gripping the protrusion 56 formed on the lower surface of the inverting table 44. Falling is prevented by engagement of a flange portion **56*a* formed at a fore end of the protrusion 56 (FIG. 3). The board carrying table 9 in this embodiment is capable of carrying boards 67** separately as two stacks.

The attracting head 22 for the boards 67 has a vacuum pad, but it may be of any type if only it can attract and convey only one top board 67 from among the stacked boards 67.

Since the system of this embodiment is constructed as above, the cones can be encased successively for example in the following order.

The operational order will now be explained with reference to the diagram of FIG. 8 in which the movement of the cone holding gripper 19 and of the inverting table holding gripper 21, that is, the movement of the moving frame 14, is indicated by a solid line, while the movement of the board attracting head 22 is indicated by a dotted line. Provided, however, that as an initial state five cones 4 are arranged in the solid-line positions in FIG. 1 on the arraying and feeding device 5; the inverting table on the inverting device 8 is in the normal condition indicated by solid lines in FIGS. 3 and 4; and the empty case 6 on the belt conveyor 7 is stopped in the solid-line position shown in FIG. 1 by means of a stopper device 68.

After the above initial state was established, the gripper 19 moves onto the arraying and feeding device 5 and grips (G1) the five erected cones 4 which are arranged in good order in a zigzag form on the device 5, at a time as previously described, then lifts and conveys them to the inverting device 8 and delivers them (UG1) to the cone engaging device 48 on the inverting table 44. In FIGS. 8 and 9, "G1" represents a gripping operation for the cones 4 by the gripper 19; "UG1" represents a cone releasing operation by the same gripper; "G2" represents a gripping operation for the inverting table 44 by the gripper 21; "UG2" represents an inverting table releasing operation by the same gripper; "UG3" represents a cone releasing operation of the engaging device 48 on the inverting table 44; "V" represents an attracting operation for the board 67 by the attracting head 22; and "UV" represents a board releasing operation.

Figure 8:
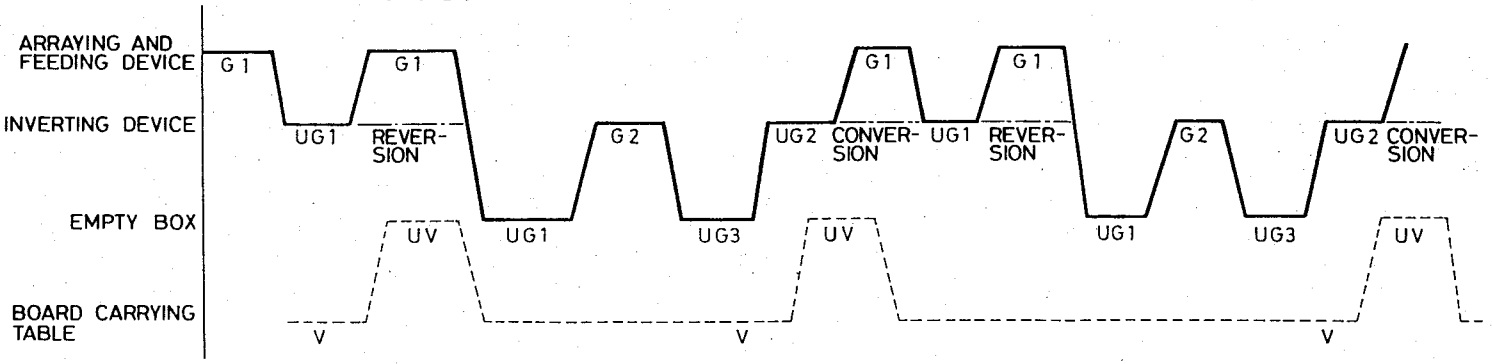
FIGS. 8 and 9 are diagrams showing orders of operations of grippers and an attracting head.
Figure 9:
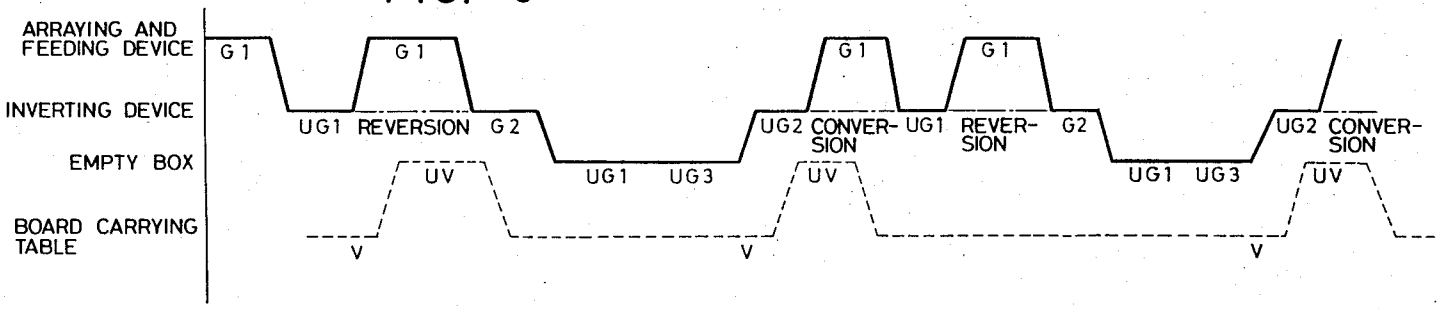

The inverting table 44 which has thus received the cones 4 is inverted as previously described in a state in which the engaging device 48 engages the cones 4 upon turning "on" of the air pressure (as indicated by alternate long and short dash line in FIG. 8). On the other hand, the attracting head 22 transfers the board 67 attracted (V) on the carrying table 9 onto the bottom of the empty case 6 as a bottom board (UV).

While the transfer of the erected cones 4 to the inverting device 8 by the gripper 19 is performed, the partitioning cylinder 28 on the arraying and feeding device 5 withdraws, so the cones 4 arranged in their positions indicated by alternate long and short dash line in FIG. 1 move forward up to their positions indicated by solid lines in the same figure, namely, the cone lifting positions, where they are arranged in order by the pusher cylinders 34 and 35. Thereafter, the five erected cones 4 are again gripped by the gripper 19 and moved up to the position of the empty case 6. Then, the gripper 19 which grips the cones 4 moves down and enters the empty case 6 and the cones are placed therein.

At the time of insertion of the first-stage erected cones 4 into the empty case 6, the erected cones 4 are smoothly inserted and placed onto the bottom of the empty case 6 because the outer peripheral edges of the gripper housing 61 and gripper units 64 are formed smaller than the opening size of the empty case 6. This is as previously noted.

By the above operations the first-stage erected cones 4 are arranged in the case 6 in an appropriate zigzag form. Then, the gripper 21 moves onto the inverting table 44 and grips the protrusion 56 of the inverting table 44 which has already been inverted (G2), then conveys the table 44 as inverted onto the empty case 6 and moves down and enters the case together with the inverting table 44. The cones 4 have been inverted by inversion of the inverting table 44 and arranged in a reverse zigzag arrangement which corresponds to the gap portions in the zigzag arrangement of the erected cones 4 placed in the case 6. Therefore, if the air pressure source is turned "off" after insertion of the inverted cones 4 into the case together with the inverting table 44, the cones are released from the engaging device 48 (UG3) and inserted exactly between the previously loaded erected cones 4 (as indicated by alternate long and short dash lines in FIG. 6). There will be no trouble at the time of this insertion because the outer peripheral edge of the inverting table 44 in plan view is smaller than the opening size of the case 6.

Then, the inverting table 44 which has become empty after release of the cones 4 is returned onto the support base 39 of the inverting device 8 (UG2) and the board 67 which has been attracted on the carrying table 9 by the attracting head 22 is placed as an intermediate partition onto the first-stage cones 4 in the case 6 now charged with erected and inverted cones 4. At the same time, the inverting table 44 which has been returned onto the support base 39 is rotated in the forward direction (indicated by alternate long and two short dashes line in FIG. 8) by the drive unit 46, resulting in that the initial state is obtained again. Thereafter, second-stage erected and inverted cones 4 are charged into the case 6 by repeating the above operations.

When the loading of the second-stage cones 4 and the placing of the top board 67 are over, the stopper device 68 is released so the case 6 is carried out on the belt conveyor 7 and the next empty box 6 is brought to the position of the stopper device 68. The empty trays 26 from which the cones 4 have been drawn up are carried out one by one onto the outgoing conveyor 3 by alternate appearance and disappearance of the partitioning cylinders 30 and 31 as previously described.

According to the above order of operation, after loading of the erected cones 4 into the case, the gripper 4 again moves to the inverting device 8, then grips the inverted cone 4 together with the inverting table 44 and releases them into the case, so the time required is prolonged by an amount corresponding to the reciprocating stroke during that period. But the time required can be shortened by adopting the following operational order.

As shown in the diagram of FIG. 9, after the gripper 19 gripped the cones 4 arranged secondly on the arraying and feeding device 5 (G1), these gripped erected cones 4 are not immediately loaded into the empty case 6 but the inverting table 44 now inverted in the position of the inverting device 8 is gripped by the other gripper 21 (G2) while the gripper 19 grips the five erected cones 4. The moving frame 14 thus holding the erected and inverted cones 4 together through the grippers 19 and 21 is moved to the position of the empty case 6 and the erected cones 4 are released successively from the gripper 19 (UG1) and the inverted cones 4 are released from the engaging device 48 and loaded (UG3).

According to the above order of operation shown in FIG. 9, the time required is shortened.

Moreover, in the robot system of the above embodiment, the inverting table 44 of the inverting device 8 is made engageable and disengageable with respect to the support base 39 and the five inverted cones 4 after inversion are conveyed together with the inverting table 44 by means of the gripper 21, so the gripper 21 can be of an extremely simple structure which is only required to grip the protrusion 56 of the inverting table. Besides, the step of holding the five inverted cones 4 by the respective corresponding gripper units is omitted, thereby shortening the time required and greatly reducing the possibility of occurrence of a trouble such as a gripping error. However, the structure of the inverting device 8 and that of the gripper 21 are not limited to the above.

Figure 10:
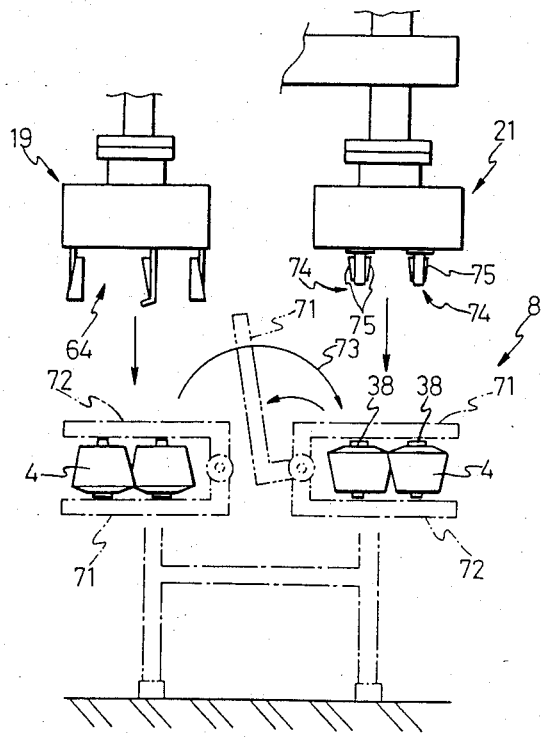
FIG. 10 is a schematic side view showing other examples of an inverting device and an inverted cone holding gripper.

For example, the inverting device 8 may be of the following structure. As schematically shown in FIG. 10, the erected cones 4 are once held from above and below on the inverting device by means of arms 71 and 72 and in this state they are inverted as indicated at 73, then are arranged in an inverted state on the other-side arm 72, and a gripper 21 having five small gripper units 74 comes into gripping engagement with the thus-inverted cones 4. In this case, the small gripper units 74 are arranged in a zigzag form opposite to the gripper units 64 of the gripper 19 and their structure may be about the same as that of the cone engaging device 48 in the above embodiment, that is, they may be of a pin structure having engaging pieces 74 adapted to be opened and closed radially by a drive source (not shown) and capable of being inserted into the core pipe 38.

Figure 11:
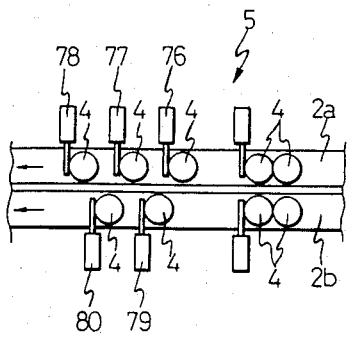
FIG. 11 is a schematic plan view showing another example of an arraying and feeding device.
Figure 12:
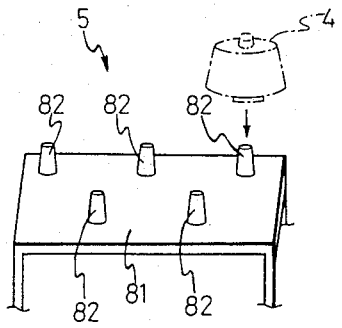
FIG. 12 is a perspective view showing a still further example.

Further, although in the above embodiment the cone arraying and feeding device 5 is composed of three belt conveyors 1, 2, 3, a number of partitioning cylinders 27–31 and pusher cylinders 32–35, the arraying conveyor 2 may be composed of two belt conveyors 2*a* and 2*b* as schematically shown in FIG. 11. In this case, the cones 4 on the belt conveyors 2*a* and 2*b* may be arranged by projection and withdrawal of partitioning cylinders 76, 77, 68, 79 and 80 disposed in desired positions. As schematically shown in FIG. 12, there may be used regulating pins 82 provided on a cone carrying table 81 for regulating the position of each cone 4, and the cones 4 may be fitted over the regulating pins 82 by using an appropriate automatic introducing device or manually by the operator.

Also as to the robot 12, it is not limited to the foregoing orthogonal coordinates type robot having the gate-like support 13. For example, it may be a multi-articulated robot or a cylindrical coordinates type robot carried on a traverse truck if only the robot is adapted to circulate among the arraying and feeding device 5, inverting device 8 and case feeding belt conveyor 7.

According to the encasing robot system of the present invention, as set forth hereinabove, even in the case of encasing a large number of conical articles in many cases, erected and inverted conical articles can be loaded into a case alternately in good order without leaving a gap by performing gripping, lifting and inverting operations stage by stage, thus affording a good encased state free of unevenness.

What is claimed is:

1. A robot system for encasing conical articles comprising a robot moving on a moving path, a conical articles arraying and feeding device, an inverting device for carrying and inverting a plurality of said conical articles and a case for enclosing therein said conical articles, said arraying and feeding device, said inverting device and said case being arranged along the moving path of the robot, wherein said robot includes first gripper means for gripping conical articles arranged on the arraying and feeding device, means for selectively moving said first gripper means from said arraying and feeding device to said inverting device to convey the articles from said arraying and feeding device to said inverting device and for moving said first gripper means from said arraying and feeding device to said case to convey articles from said arraying and feeding device to said case, means for gripping inverted conical articles arranged on the inverting device and means for moving said second gripper means from said inverting device to said case to convey the inverted articles from said inverting device to said case.

2. A robot system as claimed in claim 1, wherein each of said conical articles is inserted on a peg on a tray, respectively, and is conveyed on a belt conveyor to be erected on the tray.

3. A robot system as claimed in claim 2, wherein said inverting device comprises an inverting table mounted rotatably through support shafts at both ends thereof and a rotation drive unit for the inverting table.

4. A robot system as claimed in claim 2, wherein said arraying and feeding device includes an arraying belt conveyor for the trays, a plurality of partitioning cylinders, a plurality of pusher cylinders and guide plates which are provided on both sides of the arraying belt conveyor, said guide plates being spaced with respect to each other so as to have a first width corresponding to two trays on an inlet side of the arraying belt conveyor and a second width narrower than the width of two trays at an intermediate portion thereof so that trays carrying conical articles thereon are stopped by the projection of the partitioning cylinder and arranged in a zigzag form in the intermediate portion defined by the guide plates.

5. A robot system as claimed in claim 4, wherein said arraying and feeding device further includes an incoming conveyor and an out going conveyor for empty trays, trays which carry conical articles erected thereon and are conveyed on said incoming belt conveyor being pushed out alternately toward said arraying belt conveyor by the pusher cylinders.

6. A robot system as claimed in claim 1, wherein a partitioning board carrying table for placing a partitioning board onto the conical articles placed in a reverse zigzag form in a case is further provided along the moving path of the robot.

7. A robot system as claimed in claim 6, wherein said arraying and feeding device, said inverting device, a feed belt conveyor for the conical article housing empty case and said partitioning board carrying table are arranged substantially in parallel to each other and perpendicular to the moving path of the robot and are disposed in that order.

8. A robot system for encasing conical articles comprising:

a robot moving on a moving path, a conical articles arraying and feeding device, an inverting device for carrying and inverting a plurality of said conical articles and a case for enclosing therein said conical articles, said arraying and feeding device, said inverting device and said case being arranged along the moving path of the robot, wherein said robot provides a first gripper functioning to grip and convey conical articles arranged on the arraying and feeding device to the inverting device and further functioning to grip and convey conical articles arranged on the arraying and feeding device to the case, and a second gripper functioning to grip and convey the inverted conical articles arranged on the inverting device to the case, and wherein each of said conical articles is inserted on a peg on a tray, respectively, and is conveyed on a belt conveyor to be erected on the tray, and wherein said inverting device comprises an inverting table mounted rotatably through support shafts at both ends thereof and a rotation drive unit for the inverting table, and wherein said inverting table includes a protrusion capable of being gripped by the second gripper of the robot which is formed substantially centrally on the lower surface of the inverting table in a normal condition and a conical article engaging device which is formed on the upper surface of the inverting table.

9. A robot system as claimed in claim 8, wherein said conical article engaging device comprises engaging pieces which are adapted to be opened or closed radially by a pressurized air and are provided on the upper surface of the inverting table and an air source connected through the inverting table to the engaging pieces, each of said engaging pieces in an open state coming into close contact and engagement with the inner surface of the conical article.

10. A robot system as claimed in claim 9, wherein said engaging pieces are arranged in a zigzag form like the arrangement of the trays on the arraying and feeding device.

11. A robot system as claimed in claim 8, wherein said first gripper of the robot draws out and lifts the conical articles carried on the trays and stopped by the partitioning cylinder from each tray.

12. A robot system as claimed in claim 11, wherein said first gripper of the robot comprises a gripper housing fixed to an arm of the robot and gripper units, each of which comprises a fixed piece and an opening and closing pawl so that the conical article comes to be supported at its outside face by the fixed piece and the pawl when the pawl is closed, said gripper units being arranged in a zigzag form at the lower surface of the gripper housing and at positions being coincident with the positions of the conical articles arranged in a zigzag form on the arraying and feeding device.

13. A method of conveying articles from an arraying device to an enclosure comprising:

arranging a first plurality of articles on said arraying device;

conveying said first plurality of articles from said arraying device to an inverting device by means of a first gripper;

depositing said first plurality of articles on said inverting device;

inverting said first plurality of articles;

arranging a second plurality of articles on said arraying device;

conveying said second plurality of articles from said arraying device to said enclosure by means of said first gripper;

depositing said second plurality of articles in said enclosure;

conveying said inverted first plurality of articles from said inverting device to said enclosure by means of a second gripper;

depositing said inverted first plurality of articles in said enclosure.

14. A method as in claim 13 further comprising:

inserting a layer of material in said enclosure by means of a third gripper prior to depositing said second plurality of articles in said enclosure.

15. A method as in claim 13 further comprising:

inserting a layer of material in said enclosure by means of a third gripper after depositing said inverted first plurality of articles in said enclosure.

16. A method as in claim 13 wherein the step of inverting said first plurality of articles and the step of conveying said second plurality of articles from said arraying device to said enclosure occur substantially simultaneously.

17. A method as in claim 13 wherein the step of conveying said second plurality of articles from said arraying device to said enclosure and the step of conveying said inverted first plurality of articles from said inverting device to said enclosure occur substantially simultaneously.

18. A device for conveying articles from an arraying device to an enclosure comprising:

arrangement means for arranging a first plurality of articles and a second plurality of articles on said arraying device;

inverting means for inverting said first plurality of articles to thereby form an inverted first plurality of articles;

a first gripper for conveying said first plurality of articles from said arraying device to said inverting means and for conveying said second plurality of articles from said arraying device to said enclosure and for depositing said second plurality of articles in said enclosure; and a second gripper for conveying said inverted first plurality of articles from said inverting means to said enclosure and for depositing said inverted first plurality of articles in said enclosure.

* * * * *